US006619814B1

(12) United States Patent
Hamada et al.

(10) Patent No.: US 6,619,814 B1
(45) Date of Patent: Sep. 16, 2003

(54) SHOWCASE

(75) Inventors: Housaku Hamada, Gunma (JP); Harunobu Iguchi, Gunma (JP); Toshiaki Miyatake, Gunma (JP); Shigeru Arai, Gunma (JP); Syuuji Kashide, Gunma (JP); Kazuo Tetukawa, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/637,297

(22) Filed: Aug. 11, 2000

(30) Foreign Application Priority Data

Aug. 11, 1999 (JP) ..... 11-227919

(51) Int. Cl.[7] ..... A47B 23/06

(52) U.S. Cl. ..... 362/127; 362/92; 362/126; 362/125; 362/132; 362/225

(58) Field of Search ..... 362/127, 126, 362/125, 216, 260, 223, 92, 94, 246, 355, 351, 225, 132, 133, 145, 146, 100; 62/264

(56) References Cited

U.S. PATENT DOCUMENTS

| | | | | | |
|---|---|---|---|---|---|
| 1,915,704 | A | * | 6/1933 | Warren | 219/214 |
| 4,234,817 | A | * | 11/1980 | Teshima et al. | 313/493 |
| 4,685,201 | A | | 8/1987 | Boyd, Jr. | |
| 4,779,166 | A | * | 10/1988 | Tanaka et al. | 362/31 |
| 4,977,754 | A | * | 12/1990 | Upton et al. | 221/150 R |
| 5,083,844 | A | * | 1/1992 | Gruenberg et al. | 312/140 |
| 5,536,999 | A | * | 7/1996 | Winsor | 313/492 |
| 5,758,585 | A | * | 6/1998 | Latchinian | 108/23 |
| 5,768,898 | A | * | 6/1998 | Seok et al. | 362/92 |
| 5,915,824 | A | * | 6/1999 | Straat | 362/133 |

FOREIGN PATENT DOCUMENTS

| | | | | |
|---|---|---|---|---|
| DE | 749 989 C | | 5/1944 | |
| DE | 29717444 | * | 9/1997 | F21V/3/04 |
| EP | 0 772 275 A | | 5/1997 | |
| JP | 06 237545 A | | 8/1994 | |
| JP | 08 019202 A | | 1/1996 | |

OTHER PUBLICATIONS

Patent Abstracts of Japan, vol. 018, No. 623 (E–1635), Nov. 28, 1994.

Patent Abstracts of Japan, vol. 1996, No. 05, May 31, 1996.

* cited by examiner

*Primary Examiner*—Sandra O'Shea
*Assistant Examiner*—Bertrand Zeade
(74) *Attorney, Agent, or Firm*—Darby & Darby

(57) ABSTRACT

An object of the present invention is to provide a Showcase which is capable of enlarging a good housing space and which is provided with a lighting system that can be easily maintained, and the Showcase constitutes in a heat insulating wall a storeroom for displaying goods and provides a flat fluorescent lamp.

18 Claims, 9 Drawing Sheets

SHOWCASE

BACKGROUND OF THE INVENTION

1. Field of the Invention

The present invention relates to a Showcase which constitutes a storeroom for displaying goods in a heat insulating wall and is provided with a lighting system for illuminating the inside of the storeroom or the Showcase itself.

2. Description of the Prior Art

This type of conventional Showcase discharges a cold air from a discharge opening formed on the upper edge of an opening of a heat insulating wall having a substantially-U-shaped cross section toward a suction opening at the lower edge of the opening to form an air curtain at the opening as shown in, for example, Japanese patent application laid-open No. 91822-1995 (F25D27/00). Further, it cools down the storeroom surrounded by the heat insulating wall at a predetermined temperature. Furthermore, a plurality of fluorescent tubes are provided on the outer side of the upper edge of the opening or both side edges of the opening and under shelves to illuminate the inside of the storeroom and the Showcase itself.

The illumination structure of this conventional Showcase will now be described with reference to FIG. 11. FIG. 11 is a longitudinal side view showing a prior art Showcase 100, and reference numeral 101 designates a heat insulating wall having a substantially-U-shaped cross section. Non-illustrated side walls are provided on the both sides of the heat insulating wall 101, and a storeroom 103 is formed on the inner side of the heat insulating wall 101 and the side walls. In addition, a plurality of shelves 104 are provided to the storeroom 103 in the vertical direction.

A permeable shade 105 is provided on the outer side of the upper edge of the opening of the heat insulating wall 101, and a fluorescent tube 108 is provided on the inner side of the shade 107 to illuminate the front side of the Showcase 100. Furthermore, a shade 107 is disposed to the front edge of the side wall, and a fluorescent tube 108 is provided on the inner side of the shade 107 to illuminate the inside of the storeroom 103 and the Showcase 100. Additionally, a fluorescent tube 109 is provided on the lower surface of the front portion of the shelf 104 to illuminate goods and the like displayed on the shelf 104.

However, since the prior art Showcase uses the fluorescent tubes as a lighting system, spaces for housing the respective fluorescent tubes must be assured at attachment positions. Therefore, large spaces for housing the fluorescent tubes are required, which reduces a space for displaying-goods. In addition, sockets on the both sides must be also provided in order to attach the fluorescent tube, which makes it difficult to provide a lead wire and deteriorates the assembling operability. Further, a number of parts and the manufacturing cost may be increased.

In particular, the shade must be provided to the fluorescent tube disposed on the outer side of the upper edge of the opening in order to prevent light rays from directly entering eyes of customers and others. This deteriorates the attachment/detachment operability and the assembling operability of the fluorescent tube provided on the inner side of the shade.

Moreover, as to the fluorescent tube disposed in the storeroom, since the inside of the storeroom is cooled down to a predetermined temperature, the illumination intensity to the energized power quantity is lowered due to the temperature dependency of the fluorescent tube.

Further, since the lighting failure of the fluorescent tube occurs due to the aged deterioration in a short period of time, the maintenance such as the operation for replacing the fluorescent lamp becomes troublesome.

SUMMARY OF THE INVENTION

In order to solve the conventional technical drawbacks, an object of the present invention is to provide a Showcase which can enlarge a space for housing goods and includes a lighting system which can be easily maintained.

That is, the Showcase according to the present invention comprises a storeroom for displaying goods in a heat insulating wall, and flat fluorescent lamps are provided.

According to the present invention, since the Showcase comprises a storeroom for displaying goods in a heat insulating wall and flat fluorescent lamps are provided, it is possible to illuminate the inside of the storeroom and the outer surface of the Showcase. Consequently, the width of the attachment space can be narrowed as compared with the cases where the fluorescent tubes are used as the lighting system as in the prior art, thereby reducing the space. Further, the maintenance for replacing the illumination lamps can be facilitated, and a problems of decrease in the illumination intensity due to a temperature can be eliminated because the flat fluorescent lamps are superior in the low temperature property.

Additionally, since the flat fluorescent lamps has a durable period which is much longer than that of the conventional fluorescent tubes as the lighting system, the troublesome operation for carrying out the maintenance such as replacement of the fluorescent tubes due to the lighting failure can be avoided.

In the Showcase of the present invention, a flat fluorescent lamp is attached to the front surface of the heat insulating wall.

According to the present invention, since the flat fluorescent lamp is provided to the front surface of the heat insulating wall, the width of the illumination housing space for illuminating the front surface of the heat insulating wall can be narrowed, and the width of the entire Showcase can be reduced or the depth of the shelf can be enlarged.

In addition, since the flat fluorescent lamp attached to the front surface of the heat insulating wall hardly has heat on the surface thereof, a problem of occurrence of burn injury can be avoided even if a customer and the like touches the surface of the flat fluorescent lamp, thereby improving the safety. Moreover, since the surface of the flat fluorescent lamp is constituted by a lactescence glass surface, a shade does not have to be additionally provided. Thus, a number of parts can be reduced, and the width can be narrowed because of absence of the shade.

Further, in the Showcase according to the present invention, a shade or a ground glass is provided to the front surface of the flat fluorescent lamp.

According to the present invention, since a shade or a ground glass is provided to the front surface of the flat fluorescent lamp, the decoration can be applied to the front surface of the Showcase, thereby stimulating the buying inclination of customers.

In the Showcase according to the present invention, the flat fluorescent lamp is provided to the front portion of a ceiling surface of the storeroom.

According to the present invention, since the flat fluorescent lamp is provided to the front portion of the ceiling surface of the storeroom, it is not necessary to additionally provide a space for housing the fluorescent tube as in the prior art, thereby effectively utilizing the inside of the storeroom.

Moreover, since the flat fluorescent lamp is superior in the low temperature property, a problem of decrease in the illumination intensity can be eliminated even if it is provided in the storeroom with a relatively low temperature. Additionally, since the flat fluorescent lamp does not have heat on the surface thereof, the reduction in the cooling efficiency of the Showcase itself due to the heat load can be avoided. Further, the inside of the flat fluorescent lamp substantially forms a vacuum, it has the adiabatic effect, and dew drops can be prevented from being formed on the surface. Therefore, it is no longer necessary to use a heating element to avoid dew formation, thereby reducing the cost.

Furthermore, in the Showcase according to the present invention, the flat fluorescent lamps are provided on both sides of the opening of the storeroom.

According to the present invention, since the flat fluorescent lamps are provided on the both sides of the opening of the storeroom, the storeroom can obtain the illumination from the sides. Since the lighting system can be disposed with a small width dimension without requiring a space for providing a fluorescent tube and a shade for covering the fluorescent tube, goods mounted on the side end portion of the storeroom can be displayed without being covered with the shade and the like.

Further, in the Showcase according to the present invention, the commercial display showroom which is opened to the front side is constituted in the heat insulating wall, and a deck pan is provided on the bottom of the storeroom, the flat fluorescent lamp being disposed to the front portion of the deck pan in the horizontal direction.

According to the present invention, in the Showcase which constitutes the commercial display storeroom opened to the front side in the heat insulating wall and provides the deck pan on the bottom of the storeroom, since the flat fluorescent lamp is disposed to the front portion of the deck pan in the horizontal direction, goods displayed on the shelf and the deck pan can be illuminated because the inside of the storeroom is illuminated from the lower side, thereby improving the display effect. In addition, since the flat fluorescent lamp does not have heat load and does not hence heat the goods displayed on the deck pan and the cold air in the vicinity of these goods, the cooling efficiency can be improved. Moreover, since the flat fluorescent lamp is superior in the low temperature property even if it is provided in the vicinity of the suction opening of the cold air, the reduction in the illumination intensity can be avoided.

Additionally, the Showcase according to the present invention constitutes the commercial display storeroom opened to the front face in the heat insulating wall and provides a plurality of shelves in the storeroom, the flat fluorescent lamps being provided to the lower surfaces of the front portions of the shelves.

The present invention provides the Showcase which constitutes the commercial display storeroom opened to the front face in the heat insulating wall and provides a plurality of shelves in the storeroom, and the flat fluorescent lamps are provided to the lower surfaces of the front portions of the shelves. Therefore, goods on the shelves can be effectively illuminated. As compared to illuminating the lower shelves by using the fluorescent tubes in the prior art, a space for providing the fluorescent tubes is not required, and the lower shelves can be illuminated with a small width dimension. Thus, the dimension between the respective shelves can be enlarged.

Further, since the flat fluorescent lamp does not have the heat load and does not hence heat goods displayed on the shelf, the cooling efficiency can be improved. Moreover, when a number of shelves is increased, the heat load of the conventional lighting system using the fluorescent tubes becomes large so that the capability of the compressor must be enhanced. However, according to the present invention, the heat load is not generated and the capacity of the compressor does not have to be enhanced, which enables the cooling operation and is economically excellent.

Furthermore, the Showcase according to the present invention constitutes in the heat insulating wall a commercial display storeroom which is opened to the front face and provides a hand rail to the lower edge of the opening of the storeroom in the horizontal direction. A slant surface deeply inclined toward the storeroom is formed to the rear surface of the hand rail, and the flat fluorescent lamp is provided to the slant surface.

The present invention provides the Showcase which constitutes in the heat insulating wall the commercial display storeroom which is opened to the front face and provides a hand rail to the lower edge of the opening of the storeroom in the horizontal direction, wherein a slant surface deeply inclined toward the storeroom side is formed to the rear surface of the hand rail, and the flat fluorescent lamp is provided to the slant surface. Therefore, it is possible to illuminate goods displayed on the shelves and the deck pan, thereby improving the display effect.

In addition, the Showcase according to the present invention constitutes in the heat insulating wall the commercial display storeroom opened to the front face, and the flat fluorescent lamp is provided to the front face of the front lower wall fringing the lower edge of the opening of the storeroom.

The present invention provides the Showcase which constitutes in the heat insulating wall the commercial display storeroom opened to the front face, and since the flat fluorescent lamp is provided to the front face of the front lower wall fringing the lower edge of the opening of the storeroom, it is possible to illuminate the inside of the storeroom from the front lower side, thereby further effectively illuminating the displayed goods.

Additionally, according to the Showcase of the present invention, the front opening of the storeroom is blocked by a plurality of sliding doors so as to be opened/closed without restraint, column supports are vertically provided in the storeroom behind positions where the respective doors overlap one on another with the opening being closed, shelves being installed to the column supports, the flat fluorescent lamps being disposed to the rear surface of the column supports.

According to the present invention, in the Showcase in which the front opening of the storeroom is blocked by a plurality of sliding doors so as to be opened/closed without restraint, column supports are vertically provided in the storeroom corresponding to the rear sides of positions where the respective doors overlap one on another with the opening being closed and the shelves are installed to the column supports, since the flat fluorescent lamps are disposed to the rear surfaces of the column supports, the inside of the storeroom can be illuminated in the vertical direction from the front face, thereby effectively illuminating the goods displayed on the shelves. Moreover, since illumination is carried out by disposing the flat fluorescent lamp having a narrow width, a space for disposing the lighting system does not have to be additionally secured, the sufficient area of the shelves can be assured, thus increasing a number of goods to be displayed. Further, since the flat fluorescent lamp does not have heat load, it does not heat the goods to be displayed, thereby improving the cooling efficiency of the entire Showcase.

Furthermore, a door frame is provided to the opening edge of the storeroom and the doors are provided in the door frame. Also, the flat fluorescent lamp is provided to the rear surface of the door frame.

According to the present invention, since the door frame is provided to the opening edge of the storeroom and the doors are provided in the door frame. Further, the flat fluorescent lamp is disposed to the rear surface of the door frame. Therefore, since the illumination can be obtained from the front side in the storeroom toward the shelves, the goods on the shelves 77 can be effectively illuminated. Furthermore, since the flat fluorescent lamp is thin, the commercial display space in the storeroom can be effectively used.

DETAILED DESCRIPTION OF THE PREFERRED EMBODIMENTS

Figure 1:
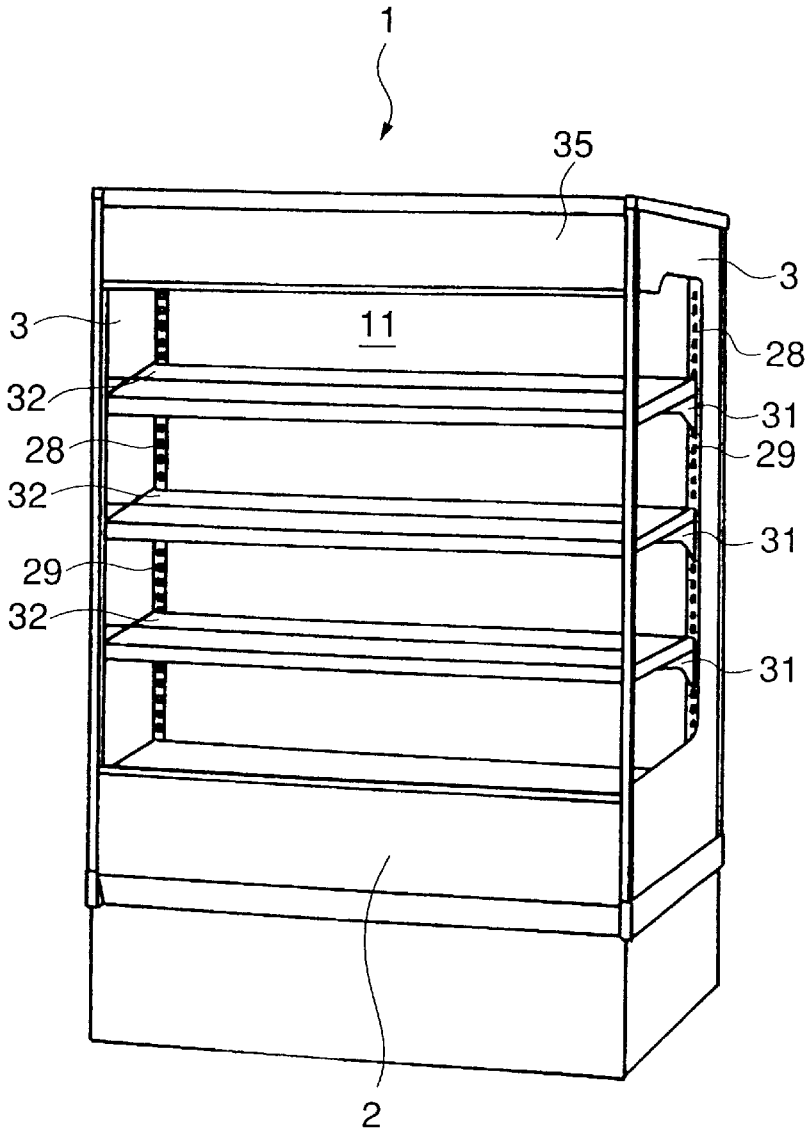
FIG. 1 is a perspective view showing a Showcase according to an embodiment.
Figure 2:
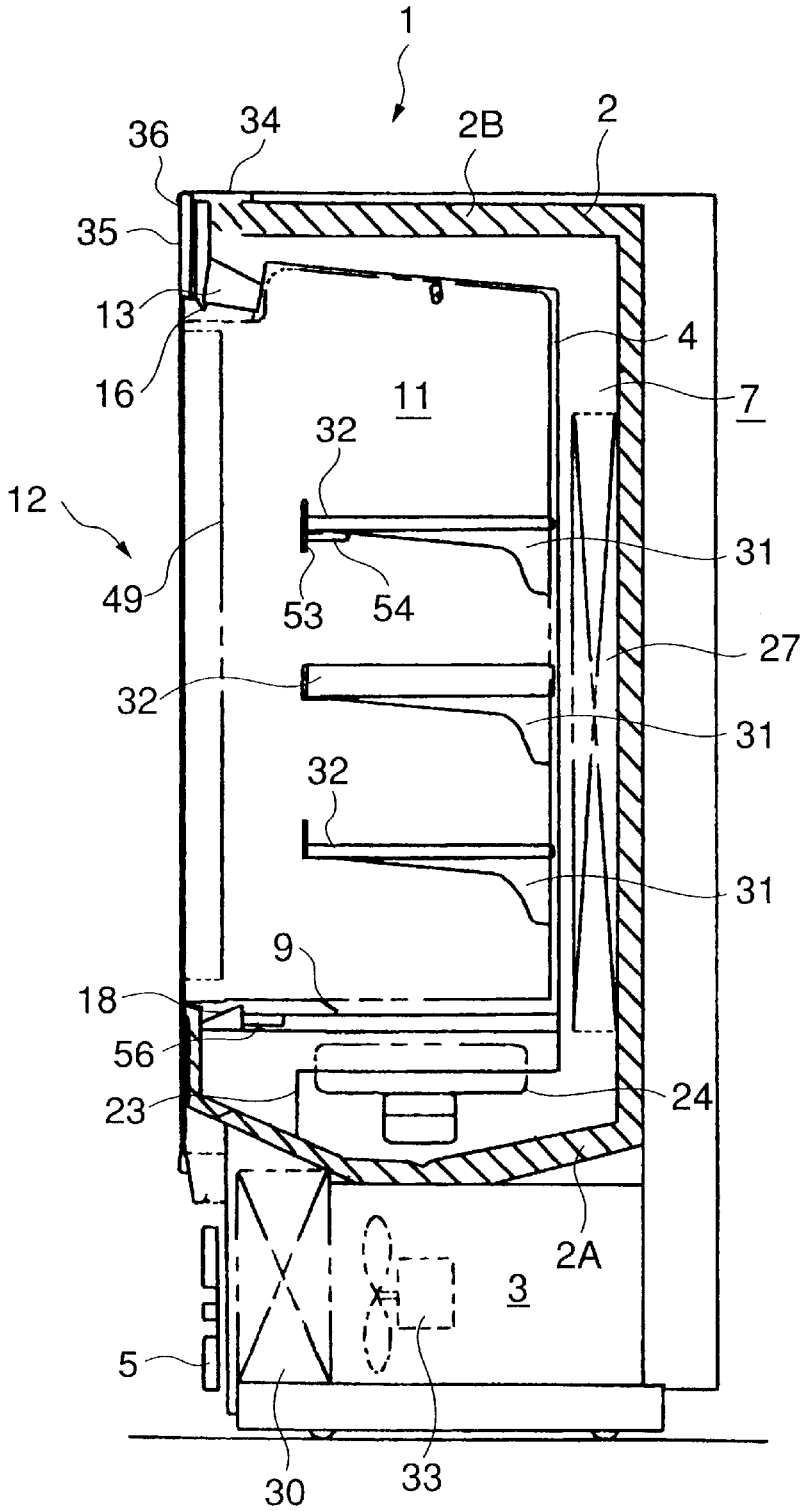
FIG. 2 is a longitudinal side view showing the Showcase according to the embodiment.

Preferred embodiments according to the present invention will now be described with reference to the accompanying drawings. FIG. 1 is a perspective view showing a Showcase according to the present invention, and FIG. 2 is a longitudinal side view illustrating a Showcase 1. The Showcase 1 according to the present invention is constituted by a heat insulating wall 2 having a substantially U-shaped cross section and side plates 3 disposed to the both sides of the heat insulating wall 2. A partition plate 4 is provided inside the insulating wall 2 with a gap therebetween, and a space between the partition plate 4 and the heat insulating wall 2 serves as a duct 7.

A deck pan 9 as a bottom plate is provided on the bottom portion of the partition plate 4, and the inside of the partition plate 4 and the deck pan 9 is determined as a storeroom 11. A discharge opening 16 to which a honeycomb member 13 is disposed is provided to the upper edge of the front opening 12 of the heat insulating wall 2. A suction opening 18 is provided to the lower edge of the opening so as to be opposed to the discharge opening 16, and the discharge opening 16 and the suction opening 18 communicate with the duct 7.

On the other hand, a fan case 23 is provided on a bottom wall 2A of the heat insulating wall 2, and an air blower 24 is disposed to the fan case 23. A cooler 27 for a cooling device is provided in the duct 7 in the rear of the partition plate 4. When the air blower 24 is operated, the cold air subjected to heat exchange with the cooler 27 is caused to move up in the duct 7 and discharged from the discharge opening 16 toward the suction opening 18. The. cold air absorbed from the suction opening 18 is again accelerated by the air blower 24. This forms an air curtain at the opening 12, and a part of the cold air curtain is circulated in the storeroom 11 so that the storeroom 11 is cooled down.

Column supports 28 are positioned at rear portions on the both sides of the storeroom 11, and a plurality of engagement holes 29 are formed on the front surfaces of the rear sides of the column supports 28 at predetermined intervals. Rear ends of a plurality of brackets 31 are detachably engaged with the engagement holes 29, and each shelf 32 is provided on a horizontal pair of brackets 31 so as to be installed in the storeroom 11.

A machine chamber 3 is formed under the bottom wall 2A of the heat insulating wall 2, and the cooler 27, a condenser 30 for forming a so called coolant cycle and a non-illustrated compressor and the like are provided in the machine chamber 3. An air blower for the condenser 33 is disposed at the rear of the condenser 30, and a grill 5 is formed to the front surface of the machine chamber 3 so that the air is taken in from the grill 5 and the waste heat is exhausted from the rear portion to the outside (see FIG. 2).

Figure 3:
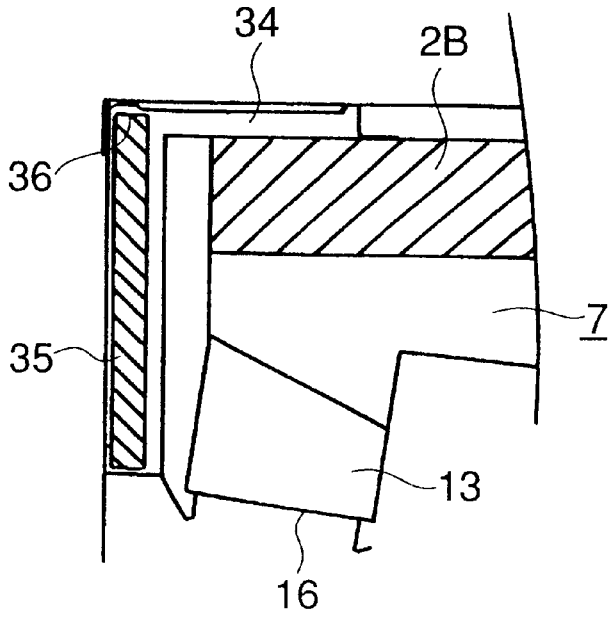
FIG. 3 is a longitudinal side view of a part of the Showcase in the vicinity of a discharge opening according to the embodiment.

On the other hand, a mounting plate 34 is disposed to the front edge of a ceiling wall 2B of the heat insulating wall 2, and this mounting plate 34 covers the front face of the heat insulating wall 2 and the front face of the discharge opening 16 from the ceiling surface of the heat insulating wall 2. A concave portion 36 opened to the front face as shown in FIG. 3 is formed to the front face of the mounting plate 34, and a flat fluorescent lamp 35 is attached to the concave portion 36.

Figure 10:
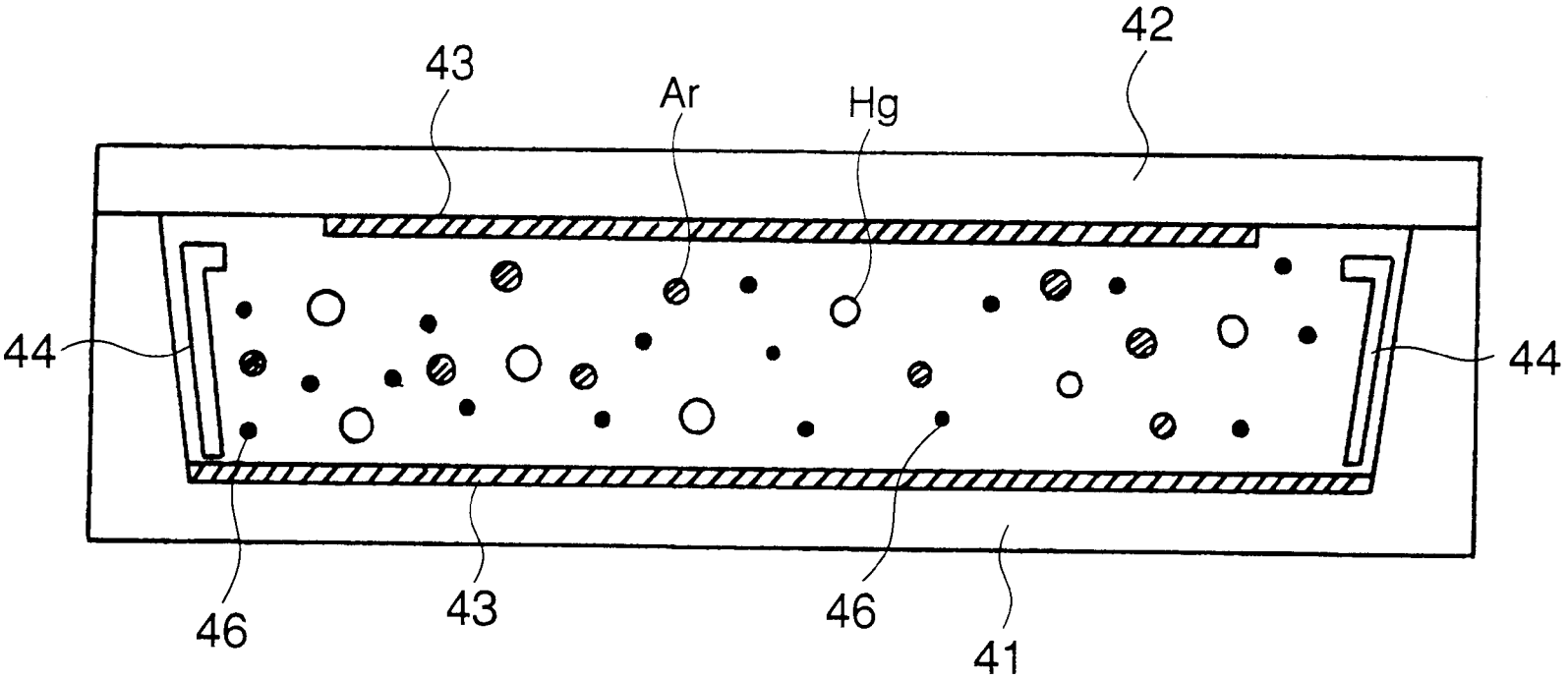
FIG. 10 is an explanatory view illustrating the structure of a flat fluorescent lamp.
Figure 11:
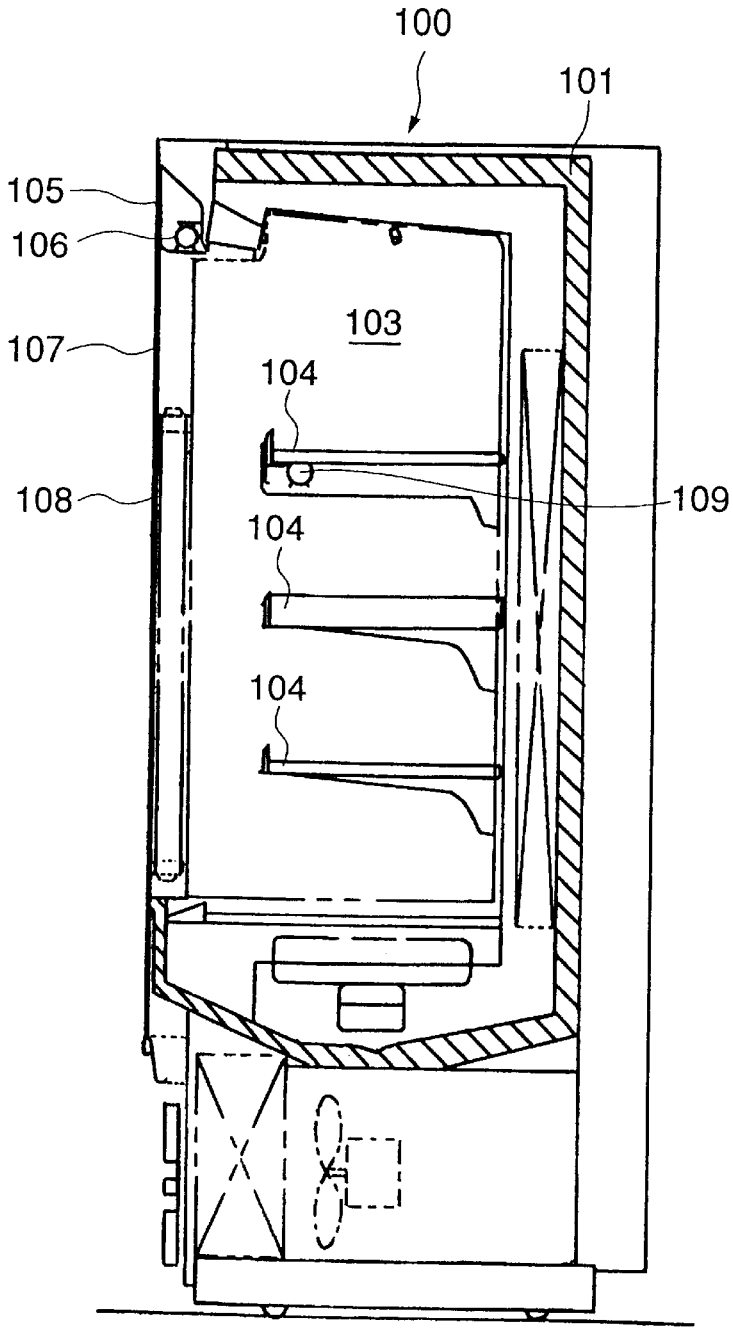
FIG. 11 is a longitudinal side view showing a conventional Showcase.

Here, the flat fluorescent lamp 35 will be described in detail with reference to FIG. 10. The flat fluorescent lamp 35 has a formed glass 41 and a flat glass 42 to form a glass container, and fluorescent materials 43 are provided on the inner side of the bottom surface and the ceiling surface of the glass container. Ignition electrodes 44 are provided on a pair of side surfaces opposed to each other in the glass container, and a non-illustrated electrode lead is connected to the ignition electrodes 44. The inside of the glass container substantially forms a vacuum, and a small amount of mercury vapor (Hg) or a small amount of noble gas such as argon (Ar) is sealed therein.

When an alternator is connected to the electrode lead through a non-illustrated wiring and the electricity is discharged between the ignition electrodes 44, accelerated electrons 46 collide with molecules of mercury (Hg) or argon (Ar) and the energy level is changed from the normal state to the excited state. When the excited molecules or atoms return to the normal state, an ultraviolet ray inherent to the respective molecules is radiated. The ultraviolet ray is emitted from the surface of the flat glass 42 as a visible light when it hit against the fluorescent materials 43. As a result, for example, a predetermined translucent white illumination intensity can be obtained from the surface of the flat fluorescent lamp 35. Further, this flat fluorescent lamp has, for example, a vertical dimension of 50 mm, a horizontal dimension of 300 mm and a width dimension of approximately 10 mm, and a plurality of the flat fluorescent lamps are provided in accordance with installation positions. However, the flat fluorescent lamp of any size can be used if the intensity of the flat fluorescent lamp is not taken into consideration.

With the above described arrangement, since the above flat fluorescent lamp 35 has the width dimension of approximately 10 mm and is thin, the lighting system for illuminating the front face of the Showcase 1 can be provided to the front face of the heat insulating wall 2 without requiring the space for disposing the fluorescent tube. This can reduce the width dimension of the mounting plate 34 which projects frontward from the discharge opening 16 for the cold air, and hence the inside of the storeroom 11 can be enlarged.

As different from providing the fluorescent tube as the lighting system, the mounting members can be simplified with the flat fluorescent lamp 35, and the assembling operability can be improved, thereby reducing the cost. Since the flat fluorescent lamp 35 emits the lactescent light from the surface thereof, the shade does not have to provided to the front face, and the cost can be reduced. Incidentally, the shade having characters or any favorable color can be provided to the front face of the flat fluorescent lamp 35 for decoration to improve the display and sales effectiveness so that the buying inclination of customers can be increased.

Further, since the flat fluorescent lamp 35 has an excellent low temperature property as compared with the conventional fluorescent tube, it can avoid reduction in the illumination intensity when used in the environment with a relatively low temperature such as a low temperature Showcase.

Furthermore, since the flat fluorescent lamp 35 does not have heat on the surface thereof, there can not occur a problem of burn injury even if a customer and the like touches it with his/her fingers, and hence the flat fluorescent lamp 35 is superior in safety. Additionally, since the heat load is not generated in the vicinity of the cold air discharge opening 16, the cooling efficiency can be improved. Since the inside of the flat fluorescent lamp 35 substantially forms a vacuum, the flat fluorescent lamp 35 has the heat insulating effect, thereby preventing dew drops from being formed on the surface. Consequently, a heater as a heating element does not have to be provided in order to prevent dew formation as in the prior art, thus reducing the cost.

Moreover, since the flat fluorescent lamp 35 has a longer durable period than the fluorescent tube, the troublesome operation for carrying out the maintenance such as replacement of the fluorescent tube due to lighting failure can be avoided.

Figure 4:
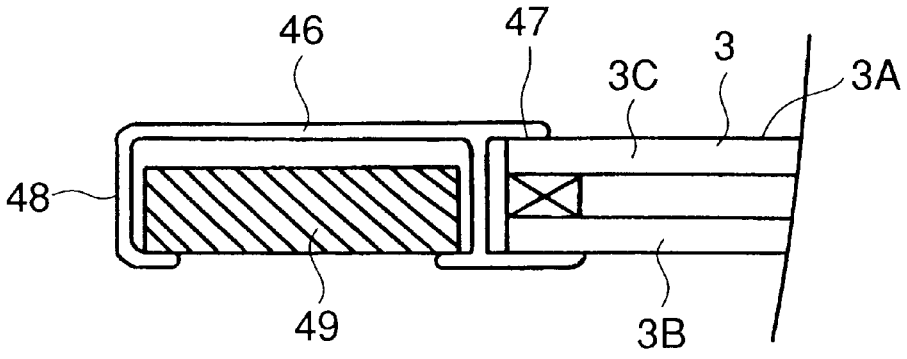
FIG. 4 is a plan cross-sectional view showing a side plate of the Showcase according to the embodiment.

On the other hand, FIG. 4 is a flat cross-sectional view of the side plate 3. The side plate 3 is constituted by two glass plates 3A and 3B, and a fixture 46 is provided to the front edge of the side plate 3 in the vertical direction. The fixture 46 is constituted by a holding portion 47 which has an opening on the side plate 3 side to support the front edge of the side plate 3 and has a substantially U-shaped cross section and a fixing portion 48 which has an opening on the storeroom 11 side and has a substantially U-shaped cross section. The both ends of the opening face of the fixing portion 48 are slightly bent inwards. A flat fluorescent lamp 49 similar to the flat fluorescent lamp 35 is accommodated in the opening face of the fixing portion 48 of the fixture 46.

The storeroom 11 can obtain the illumination from the sides by the flat fluorescent lamps 49 disposed to the front edges of the side plates 3. The inside of the storeroom 11 can be illuminated from the sides with a small width dimension without requiring the space for providing the fluorescent tube and the shade and the like for covering the fluorescent tube as in the prior art. Therefore, goods mounted on the side edge portions of the storeroom 11 can be displayed in the storeroom 11 without being covered by the shade and the like.

Although this embodiment illustrates the example where the flat fluorescent lamp 49 is disposed to the front edge of the side plate 3 by the fixture 46, the flat fluorescent lamp may substitute for the flat glass 3B constituting the inner side of the side plate 3. Further, the flat fluorescent lamp may be provided between the glass plate 3B on the inner side of the side plate 3 and the glass plate 3C on the outer side of the same.

Figure 5:
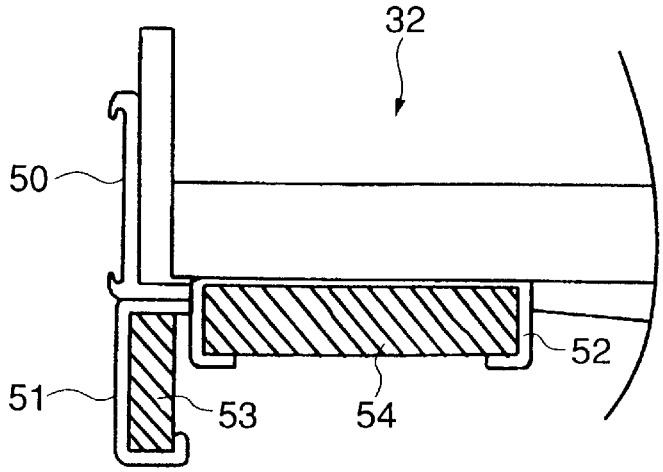
FIG. 5 is a longitudinal side view showing a shelf of the Showcase according to the embodiment.

On the other hand, FIG. 5 is a longitudinal side view showing the shelf 32. A price rail 50 for holding price tags and the like is provided to the front face of the shelf 32, and a fixture 51 which has an opening on the inner side and has a substantially U-shaped cross section is provided to the lower surface of the price rail 50. Further, a fixture 52 which has an opening on the lower side and a substantially U-shaped cross section is provided to the lower surface of the front portion of the shelf 32 and in the rear of the fixture 51. The both ends of the opening face of each of the fixtures 51 and 52 are slightly bent inwards. The flat fluorescent lamps 53 and 54 similar to the flat fluorescent lamp 35 are housed on the opening faces of the fixtures 51 and 52. Here, the vertical and horizontal dimensions of the flat fluorescent lamp 53 may be smaller than those of the flat fluorescent lamp 49. It is to be noted that the flat fluorescent lamps 53 and 54 are omitted in the shelves 32 other than the uppermost shelve in FIG. 2.

As a result, since the flat fluorescent lamps 53 and 54 are disposed to the lower surface of the shelf 32 from the upper and front sides toward the lower shelves 32, the goods on the shelves 32 can be effectively illuminated.

As compared with the case where the lower shelf is illuminated by using the fluorescent tube as in the prior art, the space for providing the fluorescent tube is not required, and the top face of the lower shelf 32 can be illuminated with a small width dimension. Therefore, the dimension between the respective shelves 32 can be enlarged.

Further, since the flat fluorescent lamps 53 and 54 do not have the heat load as similar to the flat fluorescent lamp 35, the goods displayed on the shelves 32 are not heated, thereby improving the cooling efficiency. Further, in case of the conventional lighting system using the fluorescent tube, when a number of shelves is increased, the heat load is increased and the capability of the compressor must be enlarged. However, according to the present invention, the heat load is not generated, the cooling operation can be performed without enlarging the capability of the compressor, whereby the present invention is economically superior.

When the fixture 51 or the price rail 50 is formed by a permeable material, the front face of the shelves can be illuminated, which further appeals to customers.

Figure 6:
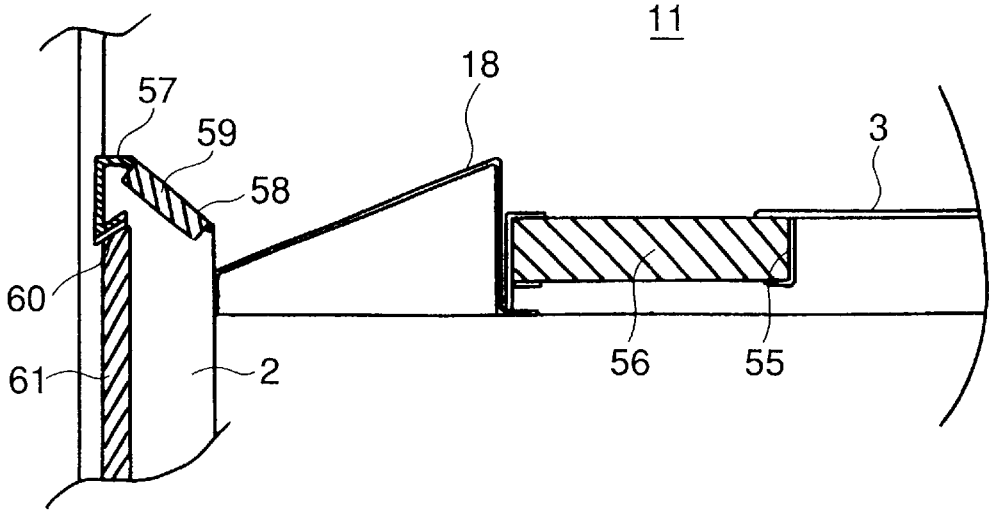
FIG. 6 is a longitudinal side view showing a lower portion of the Showcase according to the present invention.

The lower portion of the Showcase 1 will be described in detail with reference to FIG. 6. FIG. 6 is a longitudinal side view showing the lower portion of the storeroom 11. A deck pan 9 is disposed to the upper portion of the bottom wall 2A of the heat insulating wall 2 with a gap for the duct as described above, and a suction opening 18 for a cold air is provided to the front portion of the deck pan 9. Here, an opening 55 is formed between the front edge of the deck pan 9 and the suction opening 18 in the horizontal direction, and a flat fluorescent lamp 56 similar to the flat fluorescent lamp 35 is disposed to the opening 55 so as to illuminate the upper portion. Here, the top face of the flat fluorescent lamp 56 is disposed so as to be substantially flush with the top face of the deck pan 9.

As a result, since the inside of the storeroom 11 can obtain the illumination by the flat fluorescent lamp 56 from the lower side, and the goods displayed on the shelves 32 and the deck pan 9 can be effectively illuminated, thereby improving the display effect. Further, since the flat fluorescent lamp 56 does not have the heat load and does not heat the goods displayed on the deck pan 9, which improves the cooling efficiency. Additionally, since the flat fluorescent lamp 56 substantially has no temperature dependency and is superior in the low temperature property even in the vicinity of the suction opening 18 for the cold air, thus avoiding reduction in the illumination intensity.

On the other hand, a hand rail 57 is formed to the lower edge of the opening 12 of the heat insulating wall 2 (not illustrated in FIG. 2). This hand rail 57 is formed low from the front edge toward the rear side, and an opening 58 is formed in the horizontal direction. A flat fluorescent lamp 59 similar to the flat fluorescent lamp 35 is provided to the opening 58. It is to be noted that the vertical and horizontal dimensions of the flat fluorescent lamp 59 may be smaller than those of the flat fluorescent lamp 49.

As a result, the inside of the storeroom 11 can be illuminated from the front lower side by the flat fluorescent lamp 59 disposed to the hand rail 57, and the displayed goods can be further effectively illuminated.

Moreover, a concave portion 60 opened to the front face is formed to the front face of the front lower wall fringing the lower edge of the opening 12 of the heat insulating wall 2, i.e., the front face of the bottom wall 2A, and a flat fluorescent lamp 61 similar to the flat fluorescent lamp 35 is provided to the concave portion 60 (not illustrated in FIG. 2).

Since this enables illumination of the Showcase 1 from the lower side, the display and sales effectiveness can be improved. It is to be noted that the vertical and horizontal dimensions of the flat fluorescent lamp 61 may be larger than those of the flat fluorescent lamp 49.

Figure 7:
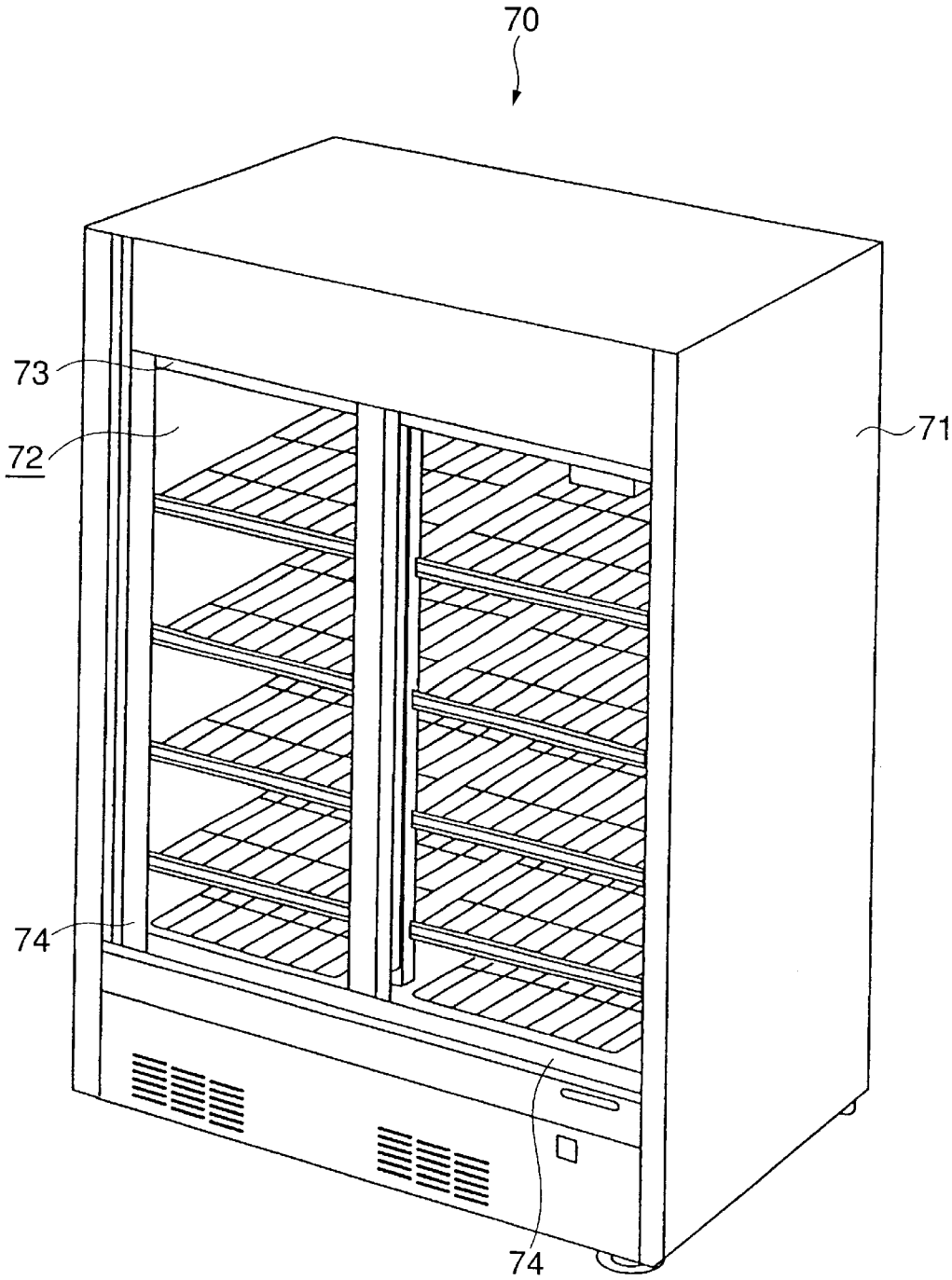
FIG. 7 is a perspective view showing a Showcase according to another embodiment.
Figure 8:
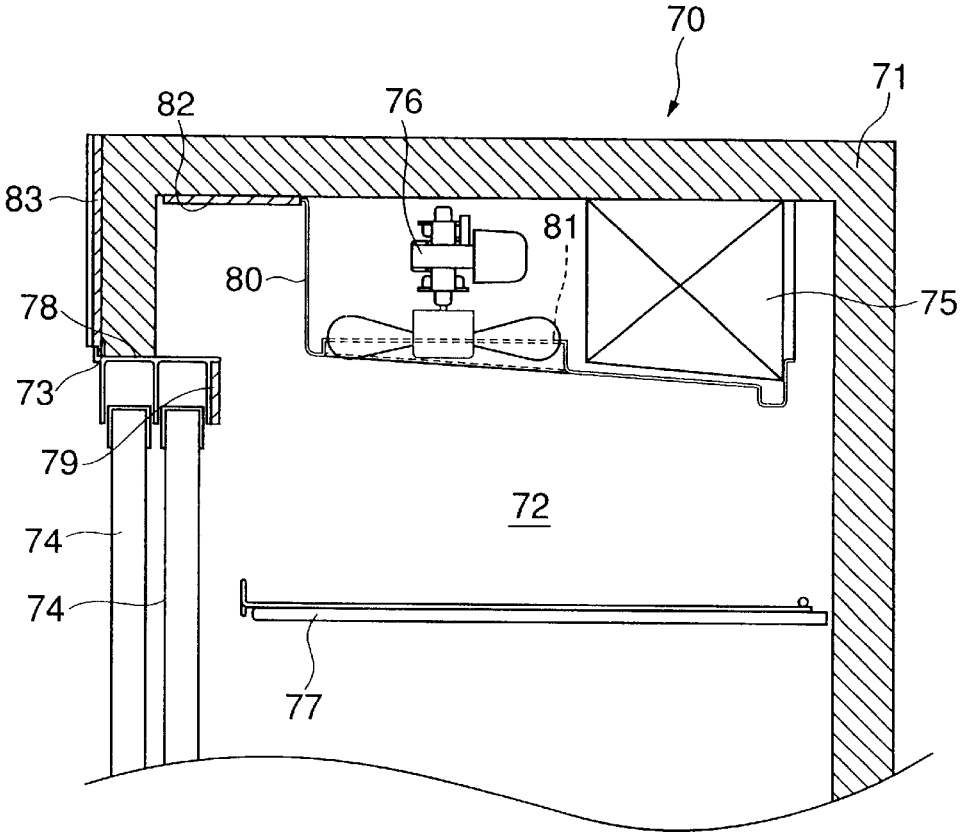
FIG. 8 is a longitudinal side view showing the upper portion of the Showcase illustrated in FIG. 7.
Figure 9:
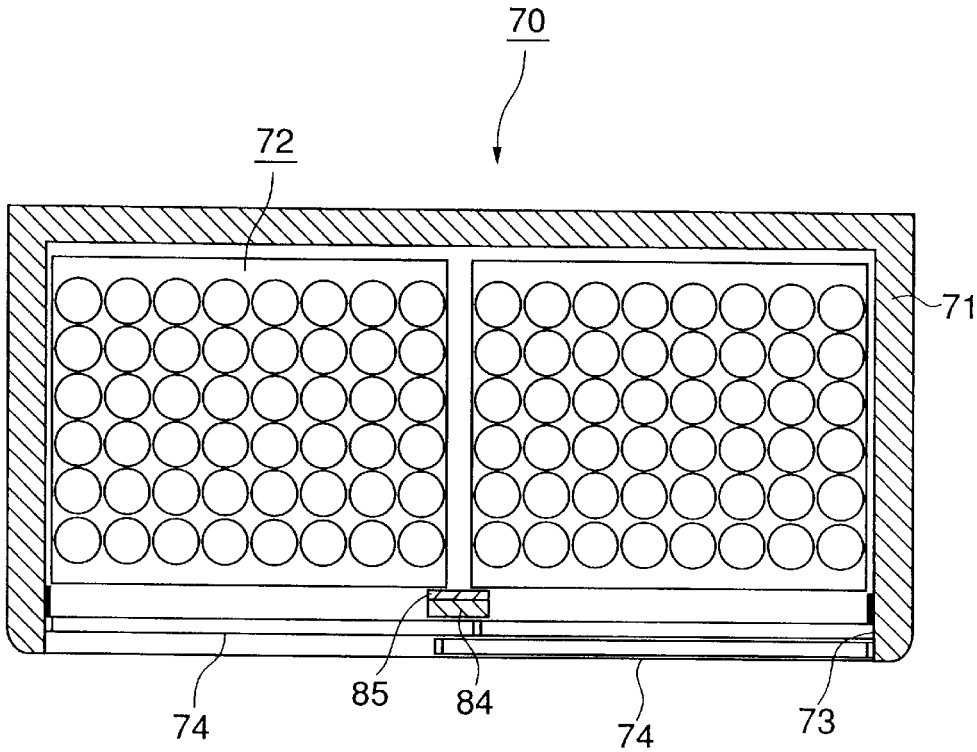
FIG. 9 is a plan cross-sectional view showing the Showcase illustrated in FIG. 7.

A Showcase 70 according to another embodiment will be explained with reference to FIGS. 7 to 9. FIG. 7 is a perspective view showing a Showcase 70; FIG. 8 is a longitudinal side view showing the upper portion of the Showcase 70; and FIG. 9 is a plan cross-sectional view showing the Showcase 70. The Showcase 70 of this embodiment is constituted by a heat insulating wall 71 opened to the front face as shown in FIG. 7, and a storeroom 72 is formed inside the heat insulating wall 71. Further, a plurality of shelves 77 for displaying goods are provided in the storeroom 72 in the vertical direction. A cooler 75 of the cooling device is provided to the upper rear portion of the storeroom 72, and an air blower 76 is disposed in front of the cooler 75. The cooler 75 and the air blower 76 are separated from the storeroom 72 by a partition plate 80. An opening 81 is formed to the partition plate 80 at a position corresponding to the air blower 76, and the inside of the storeroom 72 is cooled to a predetermined temperature by forcibly circulating the cold air from the cooler 75 by an air blower 76.

A door frame 78 is disposed to the edge of the front opening 73 of the storeroom 72, and sliding glass doors 74 are provided to the door frame 78 so that the front opening 73 is blocked so as to be opened/closed without restraint. A flat fluorescent lamp 79 similar to the flat fluorescent lamp 35 in the foregoing embodiment is horizontally attached to the door frame 78 disposed to the upper edge of the opening 73 so as to be close to the storeroom side 72.

As a result, since the flat fluorescent lamp 79 is provided to the door frame of the upper edge of the opening, the inside of the Showcase 70 can obtain the illumination from the inner front side of the storeroom 72 toward the shelves 77, thereby effectively illuminating the goods on the shelves 77. In addition, since the flat fluorescent lamp 79 has a width dimension of approximately 10 mm and is thus thin, the commercial display space in the storeroom 71 can be effectively used.

Moreover, a flat fluorescent lamp 82 similar to the flat fluorescent lamp 35 in the foregoing embodiment is horizontally disposed in front of the front side of the partition plate 80 and to the front portion of the ceiling wall 71A of the heating insulating wall 71 toward the inner side of the storeroom 71.

As a result, the inside of the storeroom 71 can obtain the illumination from the front portion of the ceiling wall 71A toward the lower side, and the goods displayed in the storeroom 71 can be hence effectively illuminated. Since the flat fluorescent lamp 82 has a narrow width dimension, an additional space for housing the lighting system is not required as compared with the case where the fluorescent tube is disposed as in the prior art, and the inside of the storeroom 71 can be effectively used.

In addition, mounting parts are hardly required as different from the prior art in which the fluorescent tube is disposed, and a number of parts can be hence decreased, thereby improving the assembling operability.

On the other hand, column supports 84 for vertically supporting the shelves 77 are provided at positions corresponding to the rear side of the positions where respective doors 74 for opening/closing the front face opening of the storeroom 71 without restraint overlap one on another with the doors 74 being closed. A flat fluorescent lamp 85 similar to the flat fluorescent lamp 35 in the foregoing embodiment is vertically provided to the rear surface of the column support 84 in order to illuminate the inside of the storeroom 71.

Consequently, since the inside of the storeroom 71 can obtain the illumination from the front face in the vertical direction, the goods displayed on the shelves 77 can be effectively illuminated. Moreover, since illumination can be effected by disposing the flat fluorescent lamp 85 having the narrow width dimension, an additional space for disposing the lighting system does not have to be secured. This can obtain the sufficient area for shelves, and a number of displayed goods can be increased. Further, since the flat fluorescent lamp 85 does not have the heat load, it does not heat the illuminated goods, thereby improving the cooling efficiency of the entire Showcase 70.

It is to be noted that the flat fluorescent lamp 83 can be disposed to the front face of the heat insulating wall 71 in this embodiment.

Although the flat fluorescent lamp is used in the Showcase 1 or 70 as the lighting system in the above description, the flat fluorescent lamp can be used in a commercial cooling refrigerator or a domestic refrigerator.

In particular, in a non-illustrated Showcase for ice cream having an opening on the top face thereof, a flat fluorescent lamp similar to the flat fluorescent lamp 35 may be provided to the lower surface of the ceiling wall in the back of the opening so that the inside of the storeroom can be illuminated when the glass doors blocking the opening so as to be opened/closed without restraint are opened. In addition, the flat fluorescent lamp may substitute for the fluorescent tube for advertisement above the ceiling wall.

According to the Showcase of the present invention, the storeroom for displaying goods is constituted in the heat insulating wall and the flat fluorescent lamps are provided, thereby illuminating the inside of the storeroom and the outer surface of the Showcase. Consequently, as compared with the case where the fluorescent tube is used as the lighting system as in the prior art, the width of the mounting space can be narrowed, reducing the space. Additionally, the maintenance for replacing the illumination lamps can be facilitated, and the flat fluorescent lamp is superior in the low temperature property, which results in elimination of the problem of reduction in the illumination intensity due to a temperature.

Also, a durable period of the flat fluorescent lamp is considerably longer than that of the fluorescent tube as the conventional lighting system, and it is possible to avoid the troublesome operation for carrying out the maintenance such as replacement of fluorescent tubes owing to the lighting failure.

Further, since the flat fluorescent lamp is provided to the front face of the heat insulating wall, the width of the illumination housing space for illuminating the front face of the heating insulating wall can be narrowed, and the width of the entire Showcase can be reduced or the depth of the shelf can be enlarged.

Moreover, the flat fluorescent lamp disposed to the front face of the heat insulating wall rarely has heat on the surface thereof, and a problem of occurrence of burn injuries can be avoided even if customers and the like touch the surface of the flat fluorescent lamp, thus improving the safety. Further, since the surface of the flat fluorescent lamp is constituted by the opaque white glass surface, a shade does not have to be additionally provided, and a number of parts can be hence reduced, narrowing the width for the shade.

In addition, since the shade or the ground glass is provided to the front face of the flat fluorescent lamp, the front face of the Showcase can be decorated to enhance the buying inclination of customers.

Moreover, since the flat fluorescent lamp is disposed to the front portion of ceiling surface of the storeroom, it is not necessary to additionally provide the space for accommodating the fluorescent tube as in the prior art, thus effectively using the inside of the storeroom.

In addition, since the flat fluorescent lamp is superior in the low temperature property, the problem of reduction in the illumination can be eliminated even if the flat fluorescent lamp is disposed in the storeroom having a relatively low temperature. The flat fluorescent lamp does not have heat on the surface thereof, and hence it is possible to avoid the decrease in the cooling efficiency of the Showcase itself due to heat load. The inside of the flat fluorescent lamp substantially forms a vacuum and thus has the heat insulating effect, which can prevent the dew drops from being formed on the surface of the lamp. Accordingly, it is not necessary to avoid dew formation by using a heating element, reducing the cost.

Since the flat fluorescent lamp is disposed at positions on both sides of the opening of the storeroom, the storeroom can obtain the illumination from the sides. Further, a space for providing the fluorescent tube and the shade and the like for covering the fluorescent tube is not required as different from the prior art. The lighting system can be provided with a small width dimension, and the goods mounted on the side end portions of the storeroom can be displayed without being hidden by the shade and the like.

In the Showcase in which the commercial display storeroom opened to the front face is constituted in the heat insulating wall and the deck pan is provided to the bottom portion of the storeroom, since the flat fluorescent lamp is horizontally disposed to the front portion of the deck pan, the inside of the storeroom can obtain the illumination from the lower side, and the goods displayed on the shelves and the deck pan can be hence illuminated, thus improving the display effect. The flat fluorescent lamp does not have the heat load and does not heat the goods displayed on the deck pan and the cold air in the vicinity of these goods, and the cooling effect can be hence improved. Furthermore, since the flat fluorescent lamp is superior in the low temperature property even if it is provided in the vicinity of the suction opening for the cold air, reduction in the illumination intensity can be avoided.

In the Showcase wherein the commercial display storeroom opened to the front face is constituted in the heat insulating wall and a plurality of shelves are provided in the storeroom, since the flat fluorescent lamp is provided to the front lower surface of each shelf, the goods on the shelves can be effectively illuminated. As compared with the case where the lower shelf is illuminated by the fluorescent tube as in the prior art, the space for providing the fluorescent tube is not required, and the top surface of the lower shelf can be illuminated with a small width dimension. Thus, the dimension between the respective shelves can be enlarged.

Further, since the flat fluorescent lamp does not have the heat load and does not heat the goods displayed on the shelves, the cooling efficiency can be improved. When a number of shelves is increased, the heat load of the conventional lighting system using the fluorescent tube becomes high, and the capability of the compressor must be increased. However, according to the present invention, since the heat load is not obtained, the capability of the compressor does not have to be increased, and the cooling operation can be performed. Therefore, the present invention is also economically excellent.

In the Showcase wherein the commercial display storeroom opened to the front face is constituted in the heat insulating wall and the hand rail is horizontally disposed to the lower edge of the opening of the storeroom, a deeply inclined surface is formed to the storeroom side, and the flat fluorescent lamp is disposed to the inclined surface. Thus, the goods displayed on the shelves and the deck pan can be illuminated to improve the display effect.

In the Showcase wherein the commercial display storeroom opened to the front face is constituted in the heat insulating wall, since the flat fluorescent lamp is disposed to the front face of the front lower wall fringing the lower edge of the opening of the storeroom, the inside of the storeroom can be illuminated from the front lower side, thereby further effectively illuminating the displayed goods.

In the Showcase wherein the front face opening of the storeroom is blocked by a plurality of sliding doors so as to be opened/closed without restraint and the column supports are vertically provided in the storeroom corresponding to the rear side of the positions where the respective doors overlap one on another with the opening being closed so that the shelves are installed to the column supports, since the flat fluorescent lamp is provided to the rear surface of the column support, the inside of the storeroom can be vertically illuminated from the front face, thus effectively illuminating the goods displayed on the shelves. Further, since the flat fluorescent lamp having a narrow width dimension is disposed to allow illumination, an additional space for providing the lighting system does not have to be assured, and the sufficient shelf area can be obtained, which can increase a number of goods to be displayed. Moreover, since the flat fluorescent lamp does no have the heat load and does not heat the goods to be illuminated so that the cooling efficiency of the entire Showcase can be improved.

Additionally, the door frame is provided to the edge of the opening of the storeroom and the doors are disposed inside the door frame. Also, the flat fluorescent lamp is provided to the rear surface of the door frame. Therefore, the inside of the storeroom can obtain the illumination from the front side toward the shelves, and the goods on the shelves 77 can be effectively illuminated. Moreover, since the flat fluorescent lamp is thin, the commercial display space in the storeroom can be effectively used.

What is claimed is:

1. A showcase comprising:

a vertically extending heat insulating rear wall and vertically extending side walls defining therebetween a storeroom for displaying goods, a cooling system for providing cooling air to the interior of said storeroom; and a flat fluorescent lamp defined by length, height, and thickness dimensions and having a length and height greater than its thickness provided on said showcase within the area defined by said rear wall and said side walls, said lamp having a major surface defined by its length and height contacted by the cooling air, and said lamp producing light in a range of visible wavelengths from the entirety of a major surface defined by its length and height directed into said storeroom.

2. The showcase according to claim 1, wherein said flat fluorescent lamp is provided on the front surface of said heat insulating rear wall.

3. The showcase according to claim 1, further comprising a shade or a ground glass provided for the surface of said flat fluorescent lamp facing outwardly of said storeroom.

4. The showcase according to any one of claim 1 through claim 3, wherein said showcase has a top forming a ceiling for said storeroom and said flat fluorescent lamp is provided on a front portion of said ceiling to direct light downwardly into said storeroom.

5. The showcase according to any one of claim 1 through claim 3, wherein there are a plurality of said flat fluorescent lamps, and at least one said flat fluorescent lamp is provided at respective positions on the interior of both side walls of said storeroom.

6. A showcase comprising:

a vertically extending heat insulating rear wall and vertically extending side walls forming a display storeroom with an open front face;

a deck pan at the bottom portion of said storeroom;

a cooling system for providing cooling air to the interior of said storeroom; and a flat fluorescent lamp having length, height and width dimensions with the length and height being greater than the width, said lamp being horizontally disposed within said storeroom with one major surface defined by the lamp length and height dimensions facing the portion of said deck pan that faces into said storeroom, said lamp having a second major opposite said one major surface that is directly contacted by the cooling air, and said lamp producing light in a range of visible wavelengths through said second major surface that is directed into said storeroom.

7. A showcase comprising a vertically extending heat insulating rear wall and vertically extending side walls forming a display storeroom with an open front face;

a plurality of horizontal shelves in said storeroom;

a cooling system for providing cooling air to the interior of said storeroom; and a flat fluorescent lamp having length, height and width dimensions with the length and height being greater than the width, said lamp disposed with one major surface defined by the lamp length and height dimensions facing the front lower surface of at least one of said shelves within said storeroom, said lamp having a second major opposite said one major surface contacted by the cooling air, and said lamp producing light in a range of visible wavelengths through said second major surface that is directed into said storeroom.

8. A showcase comprising a vertically extending heat insulating rear wall and vertically extending side walls forming a display storeroom with an open front face;

a hand rail at the lower edge of said open front face of said storeroom extending in the horizontal direction;

a cooling system for providing cooling air to the interior of said storeroom;

a slant surface within the area defined by said rear wall and said side walls inclined to the rear surface of said hand rail on said storeroom side; and a flat fluorescent lamp having length, height and width dimensions with the length and height being greater than the width, said lamp disposed with one major surface defined by the lamp length and height dimensions facing said slant surface and having a second major surface opposite said one major surface directly contacted by the cooling air, said lamp producing light in a range of visible wavelengths through said second major surface that is directed into said storeroom.

9. A showcase comprising:

a vertically extending heat insulating rear wall and vertically extending side walls defining a display storeroom with an open front surface;

a cooling system for providing cooling air to the interior of said storeroom; and a flat fluorescent lamp having length, height and width dimensions with the length and height being greater than the width, said lamp disposed with one major surface defined by the lamp length and height dimensions facing the interior of the front surface of a front lower wall fringing the lower edge of the opening of said storeroom and having a second major surface opposite said one major surface directly contacted by the cooling air, said lamp producing light in a range of visible wavelengths through said second major surface that is directed into said storeroom.

10. A showcase having a storeroom with a front face opening;

a plurality of sliding doors to be opened/closed without restraint and vertically providing column supports in said storeroom where said respective doors overlap with said opening being closed;

a plurality of horizontal shelves installed to said column supports;

a cooling system for providing cooling air to the interior of said storeroom; and a flat fluorescent lamp having length, height and width dimensions with the length and height being greater than the width provided with one major surface defined by the lamp length and height dimensions facing the rear surface of said column supports within said storeroom, said lamp having a second major surface opposite'said one major surface directly contacted by the cooling air, said lamp producing light in a range of visible wavelengths through said second major surface that is directed into said storeroom.

11. The showcase according to claim 10, wherein a door frame is provided at the opening edge of said storeroom and said sliding doors are disposed at the rear surface of said door frame.

12. The showcase of claim 1 wherein said flat fluorescent lamp is made of glass.

13. The showcase of claim 12 wherein said flat lamp is rectangular in cross-section.

14. A showcase as claimed in claim 1 further comprising means for mounting said flat fluorescent lamp to said showcase by one of brackets engaging the thickness portion of said lamp on the top and bottom, and placing a major surface against a surface of the showcase.

15. A showcase as claimed in claim 6 further comprising bracket means engaging the thickness portion of said lamp on the top and bottom for mounting said flat fluorescent lamp to said showcase.

16. A showcase as claimed in claim 7 wherein one said major surface of said flat fluorescent lamp is in contact with a said shelf lower surface.

17. A showcase as claimed in claim 8 wherein one said major surface of said flat fluorescent lamp is in contact with said slant surface.

18. A showcase as claimed in claim 9 further comprising bracket means engaging the thickness portion of said lamp on the top and bottom for mounting said flat fluorescent lamp to said showcase on the interior of said front surface.

* * * * *